US010253446B2

(12) United States Patent
Lv et al.

(10) Patent No.: US 10,253,446 B2
(45) Date of Patent: Apr. 9, 2019

(54) THREAD DEBRIS FILTERING APPARATUS

(71) Applicants: HAIER GROUP CORPORATION, Shangdong (CN); QINGDAO HAIER WASHING MACHINE CO., LTD., Shangdong (CN)

(72) Inventors: Peishi Lv, Shangdong (CN); Lin Yang, Shangdong (CN); Yunlong Tian, Shangdong (CN); Lingchen Wang, Shangdong (CN); Zunan Liu, Shangdong (CN); Qinglong Ji, Shangdong (CN); Weihai Li, Shangdong (CN)

(73) Assignees: HAIER GROUP CORPORATION, Shandong (CN); QINGDAO HAIER WASHING MACHINE CO., LTD., Shandong (CN)

( * ) Notice: Subject to any disclaimer, the term of this patent is extended or adjusted under 35 U.S.C. 154(b) by 224 days.

(21) Appl. No.: 15/127,493

(22) PCT Filed: Nov. 28, 2014

(86) PCT No.: PCT/CN2014/092488
§ 371 (c)(1),
(2) Date: Sep. 20, 2016

(87) PCT Pub. No.: WO2015/139476
PCT Pub. Date: Sep. 24, 2015

(65) Prior Publication Data

US 2017/0284012 A1 Oct. 5, 2017

(30) Foreign Application Priority Data

Mar. 21, 2014 (CN) ..... 2014 1 0107820

(51) Int. Cl.
*D06F 39/10* (2006.01)
*D06F 23/04* (2006.01)

(52) U.S. Cl.
CPC ..... *D06F 39/10* (2013.01); *D06F 23/04* (2013.01)

(58) Field of Classification Search
CPC ..... D06F 39/10; D06F 23/04
See application file for complete search history.

(56) References Cited

U.S. PATENT DOCUMENTS

2009/0229318 A1* 9/2009 Yoo ..... D06F 39/10 68/235 R
2014/0102154 A1 4/2014 Lee

FOREIGN PATENT DOCUMENTS

CN 200967897 Y 10/2007
CN 200971441 Y 11/2007
(Continued)

OTHER PUBLICATIONS

Supplemental European Search Report issued in European Patent Application No. 14 88 4890 dated Aug. 10, 2017.
(Continued)

*Primary Examiner* — Krishnan S Menon
*Assistant Examiner* — Waqaas Ali
(74) *Attorney, Agent, or Firm* — Marshall, Gerstein & Borun LLP

(57) ABSTRACT

A thread debris filtering apparatus includes a thread debris filter, where the thread debris filter includes a filter front cover (100) and a filter rear cover (200) connected with the filter front cover; a water filtering part (110) is arranged on the filter front cover (100); a water inlet (220) is arranged in the filter rear cover (200); backflow prevention structures (210) are arranged on an inner wall of the filter rear cover (200); and the backflow prevention structures (210) are
(Continued)

arranged at the lower part of the water inlet (220) and close to the water inlet (220).

12 Claims, 3 Drawing Sheets

(56) References Cited

FOREIGN PATENT DOCUMENTS

| | | | |
|---|---|---|---|
| CN | 101105000 | A | 1/2008 |
| CN | 201087296 | Y | 7/2008 |
| CN | 202124757 | U | 1/2012 |
| JP | S5082869 | U | 7/1975 |
| JP | S52-125374 | U | 9/1977 |
| WO | WO-2005/118940 | A1 | 12/2005 |
| WO | WO-2013/165203 | A1 | 11/2013 |

OTHER PUBLICATIONS

Office Action issued in Japanese Patent Application No. 2016-552316 dated Oct. 30, 2017.
International Search Report for Application No. PCT/CN2014/092488, dated Feb. 16, 2015.

* cited by examiner

THREAD DEBRIS FILTERING APPARATUS

TECHNICAL FIELD

The present disclosure relates to the field of washing machines, and in particular to a thread debris filtering apparatus.

BACKGROUND

Thread debris is generated during clothes washing by a washing machine. In order to prevent the thread debris from being attached to clothes, a thread debris filtering apparatus is arranged on a wall of an inner drum of the washing machine generally, for collecting the thread debris to achieve a purpose of clothes cleaning. In this way, after the clothes are washed, the thread debris filtering apparatus needs to be detached and cleaned, so as to avoid blockage of the thread debris filtering apparatus.

As shown in FIG. 1, in the existing thread debris filter, a net bag is used for collection. During installation, if folds exist on the net bag, a part of the link is blocked from entering the net bag by the folds after washing water flows in the net bag, causing that part of the link flows back into a washing bucket, thereby greatly influencing a collection effect. The net bag becomes dry and hard after long-time use, causing difficult cleaning and easy breeding of bacteria, and generating secondary pollution to the washed clothes, so it is difficult to meet user requirements.

The existing utility model patent with the Chinese patent application No. 201120148645.1 discloses a thread debris filter of an impeller washing machine. The thread debris filter includes a filter front wall, a filter rear wall and a check valve plate, wherein the check valve plate is installed on a water inlet in the lower part of the filter front wall. The thread debris filter is characterized in that the lower part of the filter rear wall and the lower part of the filter front wall are hinged together through a hinge shaft, and the upper part of the filter rear wall and the upper part of the filter front wall are connected together through cooperation between a clamping jaw and a clamping buckle. In the utility model patent, the following technical solution is used: the filter rear wall and the filter front wall are hinged at the lower parts through the hinge shaft, and are abutted at the upper parts through cooperation between the clamping jaw and the clamping buckle. The thread debris filter is simple and convenient to use, facilitating for a user to operate.

The above patent solves shortcomings existing in the net-bag thread debris filter; however, since the water inlet of the thread debris filter of the utility model patent is arranged in the lower part of the filter front wall and the check valve plate is arranged on the water inlet, the problem of backflow of thread debris cannot be solved, although a good filtering effect is achieved.

SUMMARY

An object of the present disclosure is to provide a thread debris filtering apparatus which does not use a net-bag filtering screen and also plays a good role of preventing backflow of thread debris.

In order to achieve the above object, the following technical solution is used in the present disclosure:

A thread debris filtering apparatus includes a thread debris filter, wherein the thread debris filter includes a filter front cover and a filter rear cover connected therewith; a water filtering part is arranged on the filter front cover; a water inlet is arranged in the filter rear cover; and backflow prevention structures are arranged on an inner wall of the filter rear cover.

Further, a height of each backflow prevention structure is 1/10 to 1/2 of a distance formed after the filter front cover and the filter rear cover are closed.

Further, the water inlet is arranged in the upper part of the filter rear cover; the backflow prevention structures are arranged below the water inlet and close to the water inlet; and a setting area of the backflow prevention structures is less than or equal to 1/2 of an area of the inner wall of the filter rear cover.

Further, the backflow prevention structures are formed by a series of convex structures, which are arranged on the inner wall of the filter rear cover and arranged in a staggered manner.

Further, each backflow prevention structure is a scaly convex structure, and side section of which is in the shape of straight teeth.

Further, the thread debris filtering apparatus further includes a filtering cover, which is arranged on an inner drum of a washing machine; the thread debris filter is installed on the filtering cover; and a distance is formed between the cover wall of the filter rear cover at the lower part of the water inlet and the inner drum of the washing machine.

Further, a water supply guiding structure is arranged on the filtering cover at the lower part of the thread debris filter; and the water supply guiding structure is formed by recessing a cover wall of the filtering cover towards a direction of the inner drum of the washing machine.

Further, a distance between an inwards recessed inner wall of the water supply guiding structure and the inner drum of the washing machine is less than or equal to a distance between a bottom wall of the filter rear cover and the inner drum of the washing machine.

Further, the water filtering part includes a filtering frame and a filtering screen; the filtering frame is a frame structure provided with a plurality of water-through ports; and the filtering screen is attached to the frame structure.

Further, the water filtering part is formed by small through holes which are arranged in the filter front cover.

The thread debris filter of the present disclosure is cooperated with the water supply guiding structure peculiar to the filtering cover; washing water flows out through water leakage holes of the filter front cover after it enters the thread debris filter and is filtered; and the scaly structures peculiar to the filter rear cover are capable of blocking the backflow of the thread debris, thereby greatly improving the collection effect. The thread debris filter is convenient to operate because a net bag is cancelled, and the collection effect is not influenced even after long-time use.

The present disclosure has the following beneficial effects:

1. The thread debris filter of the present disclosure is connected with the filtering cover in a clamping manner, and is convenient to install and detach.

2. The thread debris filter of the present disclosure includes the filter front cover and the filter rear cover which are connected through the hinge shaft; and the thread debris filter is simple to open, and convenient for thread debris cleaning.

3. The water inlet of the thread debris filter of the present disclosure is arranged in the upper part of the filter rear cover, so that the thread debris filtered by the thread debris filter is difficult to flow back into the inner drum of the washing machine.

4. Due to the arrangement of the scaly convex structures on the inner wall of the rear cover of the thread debris filter of the present disclosure, the thread debris in the thread debris filter can be further prevented from flowing back under an impact of the water flow.

5. Due to the water supply guiding structure cooperated with the thread debris filter and arranged on the filtering cover in the present disclosure, the washing water guided through the bottom of the inner drum of the washing machine is prevented from colliding the bottom wall of the thread debris filter and baffling back; and the water supply guiding structure is used for directly guiding the washing water to a water flow passage between the filter rear cover and the inner drum, and enabling the washing water to enter the water inlet through the passage, thereby ensuring the filtering effect of the thread debris filter.

6. In the present disclosure, a better filtering effect can be realized only by installing the filtering screen on the filter front cover or configuring the small filtering holes in the filter front cover instead of using the net-bag filtering screen; and an installation box is more convenient to detach, and more convenient for thread debris cleaning.

Figure 1:
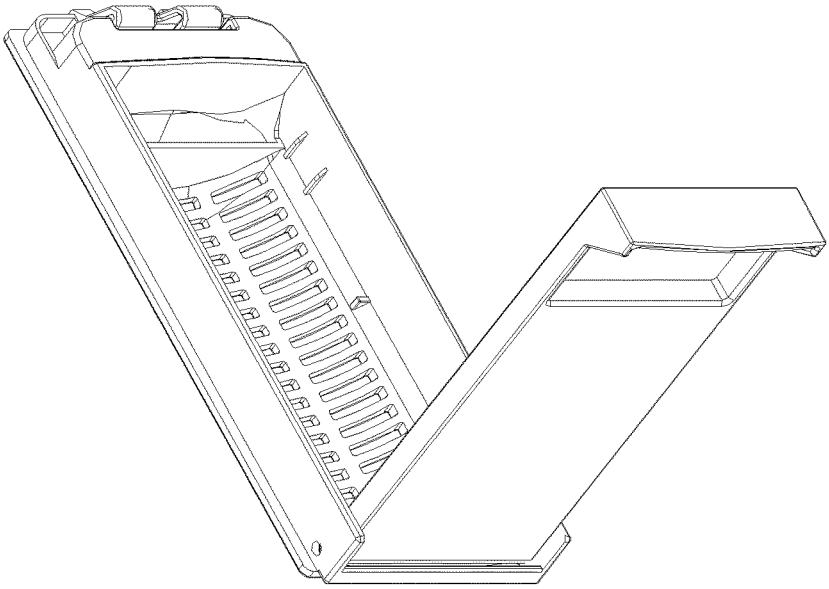
FIG. 1 is a structural schematic diagram showing an existing thread debris filter using a net-bag filtering screen.
Figure 2:
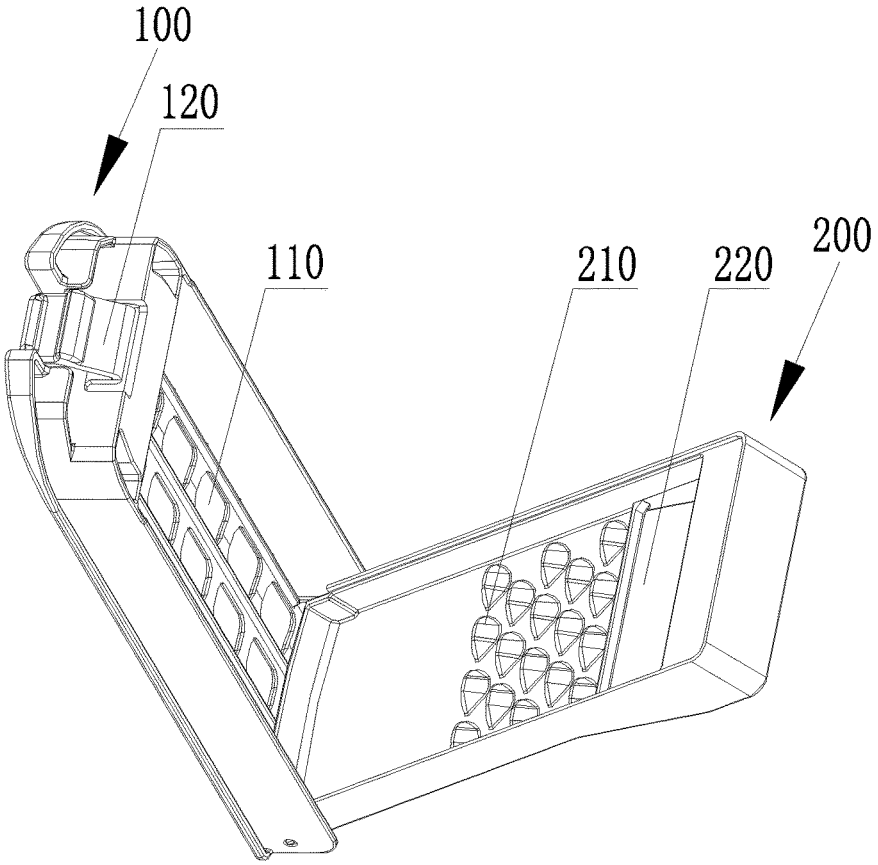
FIG. 2 is a structural schematic diagram showing a thread debris filter of the present disclosure.

Reference numerals in the drawings are listed. 100: filter front cover; 110: water filtering part; 120: clamping buckle; 200: filter rear cover; 210: backflow prevention structure; 220: water inlet; 300: filtering cover; and 310: water supply guiding structure.

DETAILED DESCRIPTION

A thread debris filtering apparatus of the present disclosure is described below in detail in combination with accompanying drawings.

The thread debris filtering apparatus provided by the present disclosure includes a thread debris filter. As shown in FIG. 1, the thread debris filter includes a filter front cover 100 and a filter rear cover 200 connected with the filter front cover; the filter front cover 100 and the filter rear cover 200 need to be closed when the thread debris filter is installed on a washing machine for use, and a closed filtering inner cavity is formed between the filter front cover 100 and the filter rear cover 200 after they are closed; and when thread debris collected in the inner cavity of the thread debris filter needs to be cleaned, the thread debris filter is taken out, and the filter front cover 100 and the filter rear cover 200 are opened for cleaning. A water filtering part 110 for enabling washing water to pass through and filtering the washing water is arranged on the filter front cover 100; a water inlet 220 is arranged in the filter rear cover 200; backflow prevention structures 210 are arranged on an inner wall of the filter rear cover 200; and the backflow prevention structures 210 are arranged below the water inlet 220.

In order to realize a role of preventing backflow of thread debris of the backflow prevention structures, and avoid an influence on a filtering effect brought by enabling the washing water to enter the inner cavity of the thread debris filter, a certain distance is formed between the backflow prevention structures 210 and an inner wall of the filter front cover 100 when the filter front cover 100 and the filter rear cover 200 are closed. A height of each backflow prevention structure 210 is 1/10 to 1/2, and preferably 1/4, of a distance formed after the filter front cover 100 and the filter rear cover 200 are closed.

In the present disclosure, the backflow prevention structures 210 are creatively arranged on the inner wall of the filter rear cover 200; and due to the additional arrangement of the backflow prevention structures 210, a phenomenon that the thread debris collected in the thread debris filter flows back under impact of water flow can be effectively prevented. In order to realize the technical effect, the arrangement and the structure of the backflow prevention structures 210 are extremely important.

As an embodiment capable of realizing the above technical effect, the backflow prevention structures 210 can be an integrated structure. Specifically, the backflow prevention structures 210 are convex ribs which are transversally arranged on the inner wall of the filter rear cover 200; in order to avoid an influence on the water flow entering the inner cavity of the thread debris filter, a certain distance needs to be formed between the tops of the convex ribs and the filter front cover 100, and the distance shall not be less than 1/2 of a width of the thread debris filter. Further, the tops of the convex ribs shall be uneven, and can be arranged in an irregular shape or in a regular corrugated shape; and such arrangement aims at that, on one hand, the influence on the entering of the water flow is avoided as far as possible; and on the other hand, the backflow of the collected thread debris is prevented as far as possible. Furthermore, more rows of convex ribs can be arranged downwards below the water inlet 220; however, an area occupied by the convex ribs shall be less than 1/2 of an area of the inner wall of the filter rear cover 200, which aims at ensuring that the thread debris filter has enough space for thread debris collection; and moreover, concave-convex parts at the tops of two adjacent rows of convex ribs shall be arranged in a staggered manner, so that the convex ribs in the present disclosure realize the optimal effect of preventing the backflow of the thread debris.

The present disclosure provides preferred backflow prevention structures 210; the lower part of the filter front cover 100 and the lower part of the filter rear wall 200 in the present disclosure are connected through the hinge shaft; the water inlet 220 is arranged in the upper part of the filter rear wall 200; a plurality of the backflow prevention structures 210 are provided, each backflow prevention structure 210 is arranged independently and small in size, and the backflow prevention structures 210 are arranged close to the water inlet 220 and arrayed downwards below the air inlet 220; and such arrangement aims at that, on one hand, the influence on the entering of the water flow from the air inlet 220 is avoided; and on the other hand, the influence on the thread debris collection is avoided; and a setting area of the backflow prevention structures 210 is less than or equal to 1/2 of an area of the inner wall of the filter rear cover 200, thereby ensuring that the thread debris filter has an enough space for thread debris collection.

In order to guarantee that the backflow prevention structures 210 are capable of playing the role of preventing the backflow of the thread debris, the backflow prevention structures 210 in the present disclosure are formed by a series of convex structures, which are arranged on the inner wall of the filter rear cover 200 and arranged in a staggered manner. The staggered arrangement of the convex structures enables the filter rear cover 200 as a whole to be transversally limited by the convex structures; in this way, it can ensure that the backflow prevention structures 210 are arranged in the entire transversal direction of the inner wall of the filter rear cover 200, capable of playing a similar role of a railing, so that the collected thread debris cannot pass through in a whole transversal area; and the backflow prevention structures 210 are arranged in the staggered manner, preventing that a vertical channel, through which the thread debris is easy to pass, is formed among the backflow prevention structures.

Each backflow prevention structure 210 in the present disclosure specifically and preferably is a scaly convex structure, side section of which is in the shape of straight teeth. The scaly convex structure has two opposite slopes, the tops of which are abutted, one slope facing the water inlet 220, and the other slope facing the bottom of the filter rear cover 200, and a gradient of the slope facing the bottom of the filter rear cover 200 is less than that of the slope facing the water inlet 220. Such arrangement aims at that, on one hand, the water flow entering from the water inlet 220 can stably enter the filtering inner cavity along the slower slope, and the thread debris in the water flow can also smoothly slide down to the filtering inner cavity; and on the other hand, the thread debris collected in the thread debris collector flows back and ascends to the backflow prevention structures 210 under the impact of the water flow, and the slope with lower gradient, like a cover is capable of effectively preventing the thread debris from continuing to ascend, thereby effectively preventing the backflow of the thread debris.

Figure 3:
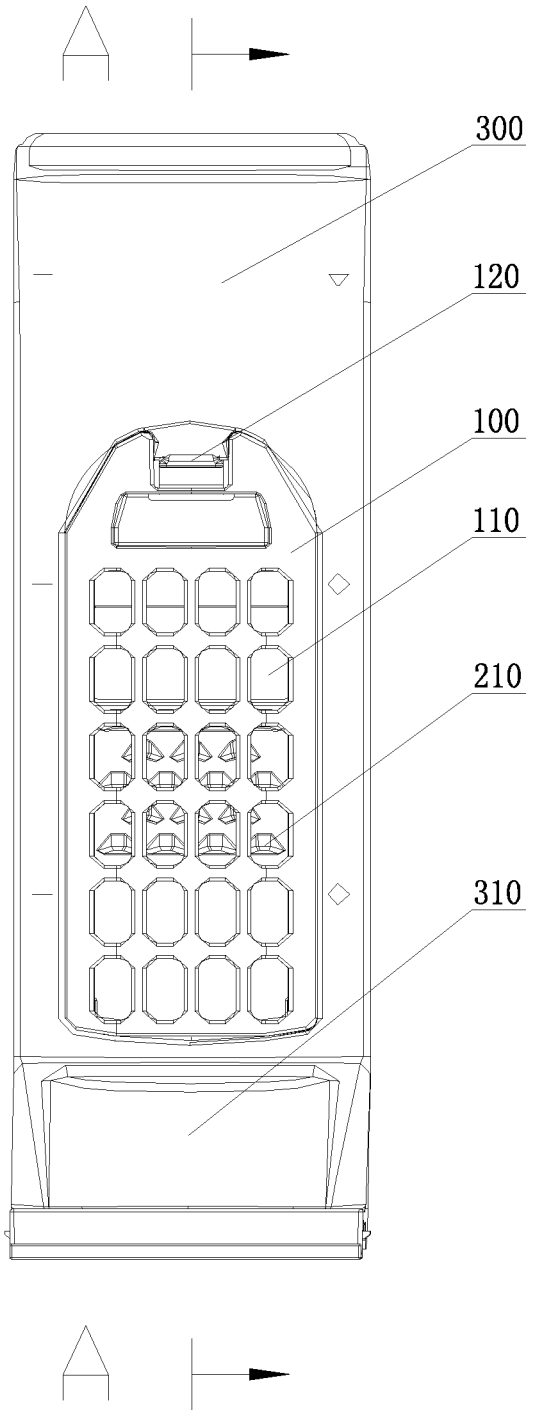
FIG. 3 is a front view of the present disclosure.
Figure 4:
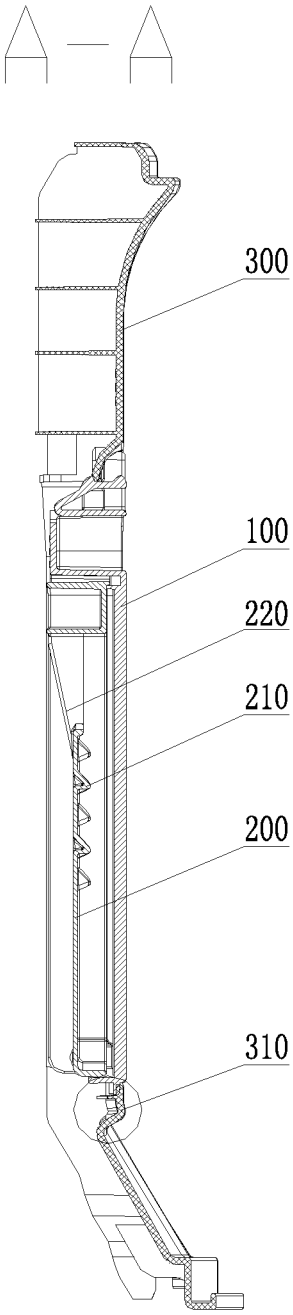
FIG. 4 is a section view along A-A plane in the front view of the present disclosure.

As shown in FIGS. 3 and 4, the thread debris filtering apparatus of the present disclosure further includes a filtering cover 300 which is arranged on an inner drum of the washing machine; the filtering cover 300 is installed on an inner wall of the inner drum of the washing machine from top to bottom; the lower part of the filtering cover 300 is connected to the bottom of the inner drum of the washing machine, and the upper part of it is connected to an opening of the inner drum; and a passage, which is available for the washing water to pass through, is formed among the filtering cover 300, the bottom of the inner drum and the inner drum. The thread debris filter is installed on the filtering cover 300; a clamping buckle 120 is arranged on the upper part of the filter front cover 100 of the thread debris filter, and the thread debris filter is connected with the filtering cover 300 in a clamping manner through the clamping buckle 120; and with the use of the clamping connection, on one hand, stability of installation of the thread debris filter can be guaranteed; and on the other hand, a user is much facilitated to detach the thread debris filter to clean or replace due to the detachable connection manner. The water inlet 220 of the thread debris filter of the present disclosure is arranged in the upper part of the filter rear cover 200; and therefore, in order to ensure smoothly entering of the washing water, a certain distance is formed between the cover wall of the filter rear cover below the water inlet 220 and the inner drum of the washing machine.

Since the thread debris filter of the present disclosure is provided with the backflow prevention structures, which occupy a certain space of the filtering inner cavity, in order to ensure the thread debris collection effect of the thread debris filter, a thickness of the thread debris filter of the present disclosure is greater than that of the existing thread debris filter; and because the filter rear cover 200 moves backwards when the thread debris filter with the increased thickness is installed on the filtering cover 300, and the bottom wall of the thread debris filter stretches out a distance, the water flow ascending from the lower part of the filtering cover 300 has a baffling phenomenon at this place, which is not facilitated for the water flow to smoothly pass through. Therefore, in the present disclosure, the structure of the filtering cover 300 is creatively designed; a water supply guiding structure 310 is arranged on the filtering cover 300 at the lower part of the thread debris filter of the present disclosure; and the water supply guiding structure 310 is formed by recessing the cover wall of the filtering cover 300 towards the direction of the inner drum of the washing machine. The water supply guiding structure 310 plays a role of reducing a water-through passage in the filtering cover 300 and changing a flowing direction of the water flow, so that the water flow does not flow towards the bottom wall of the thread debris filter as much as possible, thereby avoiding the baffling phenomenon.

In order to guarantee that the water supply guiding structure is capable of furthest preventing the baffling, a distance between the inwards recessed inner wall of the water supply guiding structure 310 and the inner drum of the washing machine is less than or equal to a distance between the bottom wall of the filter rear cover 200 and the inner drum of the washing machine; preferably, the distance between the inwards recessed inner wall of the water supply guiding structure 310 and the inner drum of the washing machine is equal to the distance between the bottom wall of the filter rear cover 200 and the inner drum of the washing machine, in this way, the baffling is avoided while a highest possible water inflow is ensured.

The water filtering part 110 plays a role of enabling the water flow entering the filtering inner cavity of the thread debris filter to flow out, filtering out the thread debris in the water flow and reserving the thread debris in the thread debris filter. Therefore, the water filtering part 110 in the present disclosure includes a filtering frame and a filtering screen; the filtering frame is a frame structure provided with a plurality of water-through ports; and the filtering screen is attached to the frame structure.

As another preferred embodiment, the water filtering part 110 in the present disclosure can also be formed by small through holes which are arranged in the filter front cover 100.

The thread debris filter of the present disclosure is cooperated with the water supply guiding structure 310 peculiar to the filtering cover 300; the washing water flows out through the water filtering part 110 of the filter front cover 100 after it enters the thread debris filter through the water inlet 220 and is filtered; and the scaly backflow prevention structures 210 peculiar to the inner wall of the filter rear cover 200 are capable of blocking the backflow of the thread debris, thereby greatly improving the collection effect. Meanwhile, the thread debris filter of the present disclosure is more convenient to operate because a net bag is cancelled, and the collection effect is not influenced even after long-time use.

The above only describes embodiments of the present disclosure and is not intended to limit the present disclosure in any form.

What is claimed is:

1. A thread debris filtering apparatus, applied in an inner drum of a washing machine, comprising a thread debris filter, wherein the thread debris filter comprises a filter front cover and a filter rear cover connected therewith; a water filtering part is arranged on the filter front cover; and a water inlet is arranged in an upper part of the filter rear cover, wherein backflow prevention structures are formed by a series of convex structures and arranged on an inner wall of the filter rear cover, the convex structures are arranged in a staggered manner, and tops of the convex structures are uneven; the backflow prevention structures are arranged below the water inlet and close to the water inlet, and a setting area of the backflow prevention structures is less than or equal to ½ of an area of the inner wall of the filter rear cover.

2. The thread debris filtering apparatus according to claim 1, wherein a height of each backflow prevention structure is 1/10 to ½ of a distance formed after the filter front cover and the filter rear cover are closed.

3. The thread debris filtering apparatus according to claim 1, wherein each backflow prevention structure is a scaly convex structure, side section of which is in the shape of straight teeth.

4. The thread debris filtering apparatus according to claim 1, further comprising a filtering cover, wherein the filtering cover is installed on an inner wall of the inner drum of the washing machine from too to bottom; the thread debris filter is installed on the filtering cover; and a distance is formed between the cover wall of the filter rear cover at the lower part of the water inlet and the inner drum of the washing machine.

5. The thread debris filtering apparatus according to claim 4, wherein a water supply guiding structure is arranged on the filtering cover at the lower part of the thread debris filter; and the water supply guiding structure is formed by recessing a cover wall of the filtering cover towards a direction of the inner drum of the washing machine.

6. The thread debris filtering apparatus according to claim 5, wherein a distance between an inwards recessed inner wall of the water supply guiding structure and the inner drum of the washing machine is less than or equal to a distance between a bottom wall of the filter rear cover and the inner drum of the washing machine.

7. The thread debris filtering apparatus according to claim 1, wherein the water filtering part comprises a filtering frame and a filtering screen; the filtering frame is a frame structure provided with a plurality of water-through ports; and the filtering screen is attached to the frame structure.

8. The thread debris filtering apparatus according to claim 1, wherein the water filtering part is formed by small through holes which are arranged in the filter front cover.

9. The thread debris filtering apparatus according to claim 2, further comprising a filtering cover, wherein the filtering cover is installed on an inner wall of the inner drum of the washing machine from too to bottom; the thread debris filter is installed on the filtering cover; and a distance is formed between the cover wall of the filter rear cover at the lower part of the water inlet and the inner drum of the washing machine.

10. The thread debris filtering apparatus according to claim 9, wherein a water supply guiding structure is arranged on the filtering cover at the lower part of the thread debris filter; and the water supply guiding structure is formed by recessing a cover wall of the filtering cover towards a direction of the inner drum of the washing machine.

11. The thread debris filtering apparatus according to claim 10, wherein a distance between an inwards recessed inner wall of the water supply guiding structure and the inner drum of the washing machine is less than or equal to a distance between a bottom wall of the filter rear cover and the inner drum of the washing machine.

12. The thread debris filtering apparatus according to claim 3, further comprising a filtering cover, wherein the filtering cover is installed on an inner wall of the inner drum of the washing machine from too to bottom; the thread debris filter is installed on the filtering cover; and a distance is formed between the cover wall of the filter rear cover at the lower part of the water inlet and the inner drum of the washing machine.

* * * * *